US007818902B2

(12) United States Patent
Launder et al.

(10) Patent No.: US 7,818,902 B2
(45) Date of Patent: Oct. 26, 2010

(54) GROUND ENGAGING DIGGING TOOTH

(75) Inventors: Brian L. Launder, Tulsa, OK (US); Charles Clendenning, Broken Arrow, OK (US); Russell N. Drake, Claremore, OK (US)

(73) Assignee: H & L Tooth Company, Tulsa, OK (US)

( * ) Notice: Subject to any disclaimer, the term of this patent is extended or adjusted under 35 U.S.C. 154(b) by 0 days.

(21) Appl. No.: 12/291,568

(22) Filed: Nov. 12, 2008

(65) Prior Publication Data

US 2010/0115803 A1 May 13, 2010

(51) Int. Cl.
*E02F 9/28* (2006.01)

(52) U.S. Cl. ..... 37/452; 37/454; 37/455; 37/456; 37/457; D15/29

(58) Field of Classification Search ..... 37/452, 37/454, 456, 457; 299/101; 172/371, 378, 172/380; D8/13; D15/29
See application file for complete search history.

(56) References Cited

U.S. PATENT DOCUMENTS

| | | | | | |
|---|---|---|---|---|---|
| 294,247 | A | * | 2/1884 | McDonald | 299/42 |
| 851,970 | A | * | 4/1907 | Wallace | 299/101 |
| 1,023,409 | A | * | 4/1912 | Batulis | 299/101 |
| 1,237,610 | A | * | 8/1917 | Brenno | 172/369 |
| 1,346,261 | A | * | 7/1920 | Schmutte | 172/731 |
| 1,755,651 | A | * | 4/1930 | Kingsbury | 294/55.5 |
| 2,702,698 | A | * | 2/1955 | Snyder et al. | 299/101 |
| D182,418 | S | * | 4/1958 | Kushner | D8/9 |
| 3,226,149 | A | * | 12/1965 | McJohnson | 294/50 |
| D207,451 | S | * | 4/1967 | Wilson | D15/29 |
| 3,841,709 | A | * | 10/1974 | Kniff | 299/101 |
| 4,028,823 | A | | 6/1977 | Edwards et al. | |
| D246,498 | S | * | 11/1977 | Polc | D8/11 |
| 4,117,611 | A | * | 10/1978 | Hemphill | 37/452 |
| D251,408 | S | * | 3/1979 | Cumberlidge et al. | D8/13 |
| 4,204,348 | A | * | 5/1980 | Lydie | 37/404 |
| 4,327,509 | A | * | 5/1982 | Bean | 37/404 |
| D306,121 | S | * | 2/1990 | Roman | D8/10 |
| 5,111,599 | A | * | 5/1992 | DeSalvo et al. | 37/301 |
| 5,502,905 | A | * | 4/1996 | Cornelius et al. | 37/460 |
| D389,843 | S | * | 1/1998 | Moreno | D15/29 |
| D397,697 | S | * | 9/1998 | Launder et al. | D15/29 |

(Continued)

*Primary Examiner*—Thomas A Beach
*Assistant Examiner*—Matthew R Buck
(74) *Attorney, Agent, or Firm*—Law Office of John W. Harbst

(57) ABSTRACT

A one-piece digging tooth having a socket opening to a rear end of the tooth for receiving and accommodating at least a lengthwise portion of a nose portion of an adapter extending forward from earth working equipment. The digging tooth has a top surface and a bottom surface which angularly diverge from each other between a forward end and the rear end of the tooth and two side surfaces. The tooth further includes a longitudinally elongated and centrally disposed tine with another longitudinally elongated tine outwardly cantilevered from and disposed to opposite lateral sides of and extending generally parallel to the central tine. To enhance their penetration capability, a width and thickness of all the tines constantly diminishes as the tines longitudinally extend toward the forward edge of the tooth. Opposed side surfaces on each tine are separated from each other by a longitudinally cleft whereby providing the digging tooth with at least two channels for directing materials, worked free by the tines, rearwardly toward and into the earth working equipment.

8 Claims, 7 Drawing Sheets

U.S. PATENT DOCUMENTS

D429,128 S * 8/2000 Todd ..... D8/10
6,247,255 B1 * 6/2001 Clendenning ..... 37/452
D446,223 S 8/2001 Edwards
6,490,816 B2 * 12/2002 Ketting ..... 37/454
7,114,272 B2 * 10/2006 Clendenning et al. ..... 37/452
D546,646 S * 7/2007 Shan ..... D8/13

* cited by examiner

GROUND ENGAGING DIGGING TOOTH

FIELD OF THE INVENTION DISCLOSURE

The present invention disclosure generally relates to ground engaging tools and, more particularly, to a ground engaging digging tooth.

BACKGROUND OF THE INVENTION DISCLOSURE

Many of today's ground engaging equipment i.e., backhoes, power shovels, and related devices includes a bucket having a transversely extending leading edge. During operation, poor ground and soil conditions are frequently encountered making digging very difficult. Often, the ground to be worked is rocky, frozen or simply very well packed and dense, such as compacted adobe, decomposed granite roads, and etc.

To facilitate ground penetration, a series of laterally spaced digging tooth assemblies extend forward from the leading edge of the bucket. Some digging tooth assemblies embody a two-piece design including an adapter connected to and extending forward from the leading edge of the bucket and a replaceable digging tooth mounted on and carried by the adapter. Some digging tooth designs have a transversely extending cutting edge extending across a forward edge of the tooth. Since a number of the cutting edges on the teeth contact the ground at the same time, penetration into hard ground conditions can be difficult and very limited.

A wide variety of digging tooth designs have been proposed to overcome the problem of penetrating hard ground conditions. Some such digging tooth designs include a single forwardly extending tine for facilitating a ground fracturing effect. While often effective, a single tine offers a relatively narrow penetration zone. A single tine digging tooth also tends to wear rapidly and requires frequent replacement.

Digging teeth having dual tines are also known in the art. As compared to a digging tooth having a transversely extending cutting edge extending across an entirety of a forward end of the tooth, a digging tooth having two elongated tines at a forward end thereof can and frequently does offer reduced resistance in penetrating the ground. Wear of the tines on the tooth, however, remains a problem. Moreover, and unless the points or tines on the digging tooth are adequately spaced apart from each other, the space therebetween can and frequently does entrap rocks therebetween whereby furthermore reducing the efficiency of the digging tooth. Also, and depending upon their placement along the front edge of the bucket, the two tines on the digging tooth can have different wear patterns associated with each tine which can result in an increase in the amount of "throw away" of a worn tooth.

Thus, there is a need and continuing desire for a digging tooth offering enhanced penetration with reduced "throw away".

SUMMARY OF THE INVENTION DISCLOSURE

In view of the above, and in accordance with one aspect, there is provided, a one-piece digging tooth defining a socket opening to a rear end of the tooth for receiving and accommodating at least a lengthwise portion of a nose portion of an adapter extending forward from earth working equipment. The digging tooth has two sides along with a top surface and a bottom surface which angularly diverge from each other as they extend between a forward end and the rear end of the tooth. The tooth further includes a longitudinally elongated and centrally disposed tine with another longitudinally elongated and outwardly cantilevered tine disposed to opposite lateral sides of and extending generally parallel to the central tine. The tines are arranged along a central axis of the tooth so as to allow the tooth to be reversed about its axis whereby enhancing continued use of the tooth and significantly reducing "throw away" for the tooth. To enhance their penetration into hard dense, and rocky soil conditions, a width and thickness of all the tines constantly diminishes as the tines longitudinally extend toward the forward edge of the tooth. Opposed side surfaces on each tine are separated from each other by a cleft which terminates rearwardly from the forward edge of the tooth in a generally U-shaped relief, when viewed in plan. The two longitudinally elongated clefts defined between the tines facilitates bucket fill by channeling material toward the bucket.

In one form, the tooth is releasably secured to the adapter by a retainer apparatus passing through axially aligned bores defined toward the rear end of the tooth. In another preferred form, the top surface of the digging tooth includes a raised and longitudinally elongated rib for adding strength and rigidity to the central tine. In still another form, the bottom surface of the digging tooth includes a raised and longitudinally elongated rib for adding strength and rigidity to the central tine. The outwardly cantilevered design of two tines provides a lateral distance between the side surfaces of the tooth at a terminal end of the tines which is greater than the lateral distance between the side surfaces of the tooth at the rear end of the tooth whereby adding protection to both the rearwardly disposed bucket lip and the retainer apparatus used to releasably secure the tooth and adapter in operable combination.

Many operators prefer to use a flex-pin retainer as the retainer apparatus of choice for holding the digging tooth and adapter in operable combination relative to each other. In this regard, and in a preferred embodiment, an area arranged in proximate relation relative to the bore defined by the tooth is configured to impart radial compression to a conventional flex-pin retainer apparatus as such apparatus is inserted into a position to maintain the digging tooth and adapter in operable combination relative to each other. In another form, an area arranged in proximate relation relative to the bore in the digging tooth is configured to inhibit inadvertent axial separation of the retainer apparatus relative to the tooth or adapter.

According to another aspect, there is provided a one-piece digging tooth having a shank portion and a working portion extending from and arranged in axially aligned relation relative to the shank portion. The shank portion of the tooth defines a blind socket which opens to a rear end of the tooth for receiving and accommodating at least a lengthwise portion of a nose portion of an adapter extending forward from an edge of earth working equipment. The working portion of the tooth has multiple longitudinally disposed tines which are arranged relative to a central axis of the tooth whereby allowing the tooth to be reversed about the centerline while maintaining the tines in substantially corresponding relation relative to the central axis of the tooth and to the bucket. The tines include a longitudinally elongated and centrally disposed tine with another longitudinally elongated tine disposed to opposite lateral sides of and extending generally parallel to the central tine. To enhance ground penetration, a width and thickness of all the tines constantly diminishes as the tines longitudinally extend forward from the shank portion toward a forward edge of the tooth. Moreover, opposed side surfaces on each tine are separated from each other by a longitudinally elongated cleft which terminates rearwardly from the forward edge of the tooth in a generally U-shaped relief, when viewed in plan. As such, the digging tooth is provided with at least two channels which facilitate bucket fill by directing materials, worked free by the tines at the working portion of the tooth, to be channeled into the bucket. In this embodiment, the central tine has a greater longitudinal length than the other tines.

Preferably, the tooth is releasably secured to the nose portion of the adapter by a retainer apparatus passing through a pair of axially aligned bores defined by the shank portion of the tooth. In one form, top, bottom and side surfaces are provided on the tooth. The top and bottom surfaces on the tooth angularly diverge relative to each other as each surface extends away from a terminal ends of the tines. In one form, the tines arranged laterally outboard from the central tine have an outwardly cantilevered deign so as to provide a lateral distance between the side surfaces of the tooth at a terminal end of the tines which is greater than the lateral distance between the side surfaces of the tooth at the rear end of the tooth. Such design adds significant wear protection to both the rearwardly disposed bucket lip and the retainer apparatus releasably joining the tooth and adapter in operable combination relative to each other.

In one design, an area of the digging tooth arranged in proximate relation relative to the bores in the tooth is configured to inhibit inadvertent separation of the retainer apparatus relative to the adapter or tooth. Preferably, the top surface of the digging tooth includes a raised and longitudinally elongated rib for adding strength and rigidity to the central tine. In a preferred embodiment, the bottom surface of the digging tooth also includes a raised and longitudinally elongated rib for adding strength and rigidity to the central tine.

According to another aspect, there is provided a one-piece digging tooth having a shank portion and a working portion extending from and arranged in axially aligned relation relative to the shank portion. The shank portion of the tooth defines a blind socket which opens to a rear end of the tooth for receiving and accommodating at least a lengthwise portion of the nose portion of an adapter extending forward from an edge of earth working equipment. The working portion of the digging tooth has more than two longitudinally elongated tines positioned in the same plane relative to each other and which are arranged relative to a central axis of the tooth whereby allowing the tooth to be reversed about the centerline while maintaining the tines in substantially corresponding relation relative to the central axis of the tooth and to the bucket. The tines includes a longitudinally elongated and centrally disposed tine and a pair of longitudinally elongated tines arranged in mirror symmetry on opposite lateral sides of and extending generally parallel to the central tine. A width and thickness of all the cantilevered tines constantly diminishes as the tines longitudinally extend forward from the shank portion toward a forward edge of the tooth. Opposed side surfaces on each tine are separated from each other by a longitudinally elongated cleft which terminates rearwardly from the forward edge of the tooth in a generally U-shaped relief, when viewed in plan. Preferably, the central tine has a greater longitudinal length than either of the other two tines to promote initial fracturing of the ground with minimal force. The multiple cantilevered tines serve to enhance the distribution of the load applied to the tooth.

Preferably, the tooth is releasably secured to the adapter nose portion by a retainer apparatus passing through a pair of aligned bores defined by the tooth shank portion. In this embodiment, the bores are aligned along an axis. In one design, the axis defined by the bores of the tooth intersects with and passes through the blind cavity defined by the tooth shank portion.

Top, bottom and side surfaces are provided on the tooth. The top and bottom surfaces of the tooth angularly diverge away from each other as each surface extends away from a terminal ends of the tines. Moreover, a cumulative lateral distance between the side surfaces of the tooth at a terminal end of the tines is greater than the lateral distance between the side surfaces of the tooth at the rear end of the tooth such that the bucket edge and retainer apparatus are beneficially provided with additional wear protection.

In one form, the digging tooth is provided with a secondary lock to inhibit inadvertent axial separation of the retainer apparatus relative to the adapter or tooth. Preferably, the top surface of the digging tooth includes a raised and longitudinally elongated rib for adding strength and rigidity to the central tine. In another form, the bottom surface of the digging tooth includes a raised and longitudinally elongated rib for adding strength and rigidity to the central tine.

DETAILED DESCRIPTION OF THE INVENTION DISCLOSURE

Figure 1:
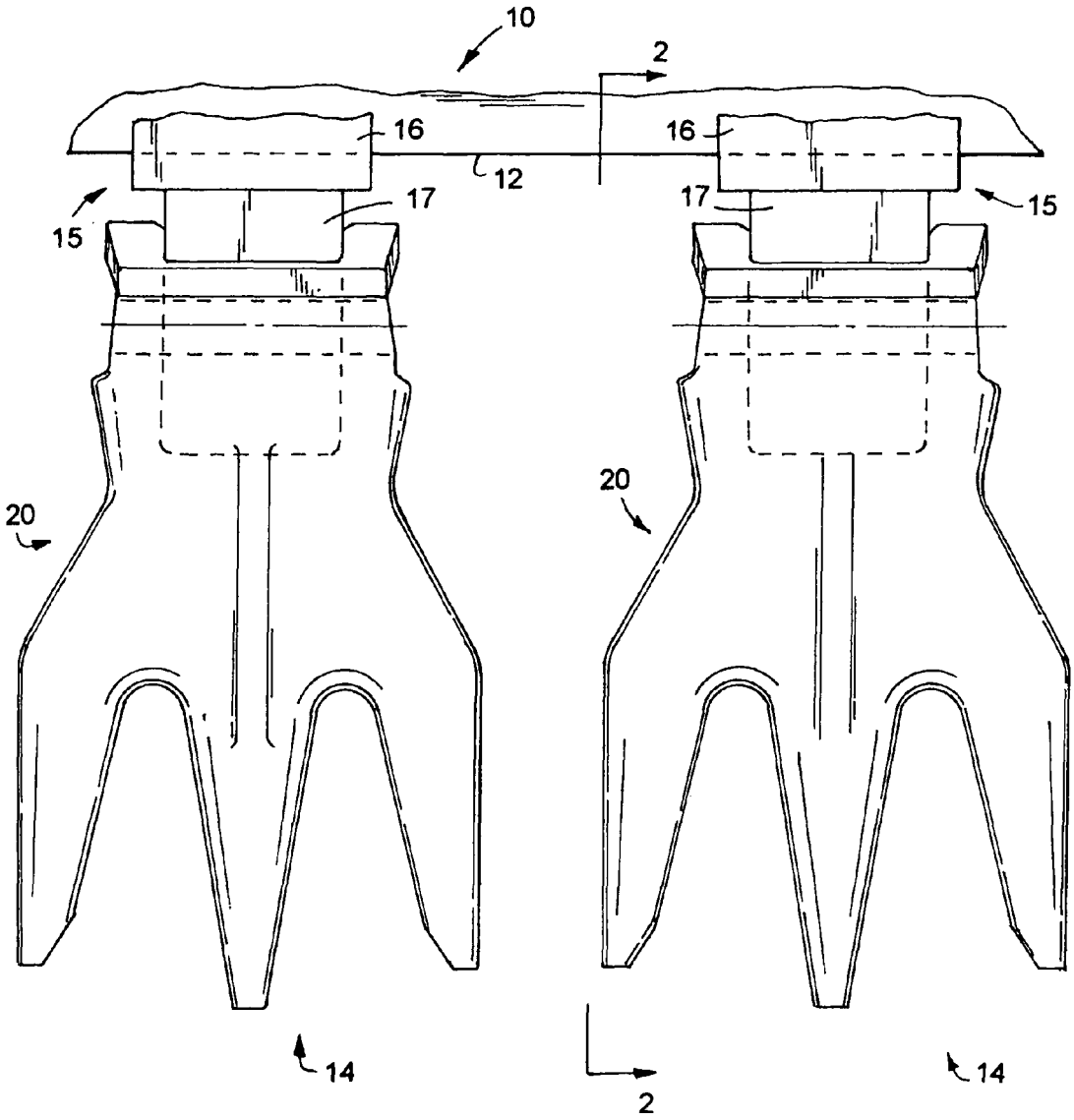
FIG. 1 is a fragmentary top plan view of one form digging tooth embodying principals of the invention disclosure attached to a ground engaging implement.

While the present invention disclosure is susceptible of embodiment in multiple forms, there is shown in the drawings and will hereinafter be described a preferred embodiment of the invention disclosure, with the understanding the present disclosure is to be considered as setting forth an exemplification which is not intended to limit the invention disclosure to the specific embodiment illustrated and described.

Referring now to the drawings, wherein like reference numerals indicate like parts throughout the several views, there is shown in FIG. 1 a fragmentary plan view of a bucket for a backhoe, power shovel, or related ground working implement or equipment generally identified by reference numeral 10. Such ground working equipment 10 is typically provided with a transverse extending lip or leading edge 12 and has a plurality of multipiece digging tooth assemblies 14 arranged in laterally spaced relation relative to each other along and extending forward from such lip or leading edge 12 to enhance the ground penetrating ability of the bucket 10. Each multipiece tooth assembly 14 includes an adapter 15 and digging tooth or tool 20. The adapter 15 is attached to and extends forward from the lip or leading edge 12 of the bucket 10 and typically includes a base portion 16 and a nose portion 17 arranged in axially aligned relation relative to each other.

Figure 2:
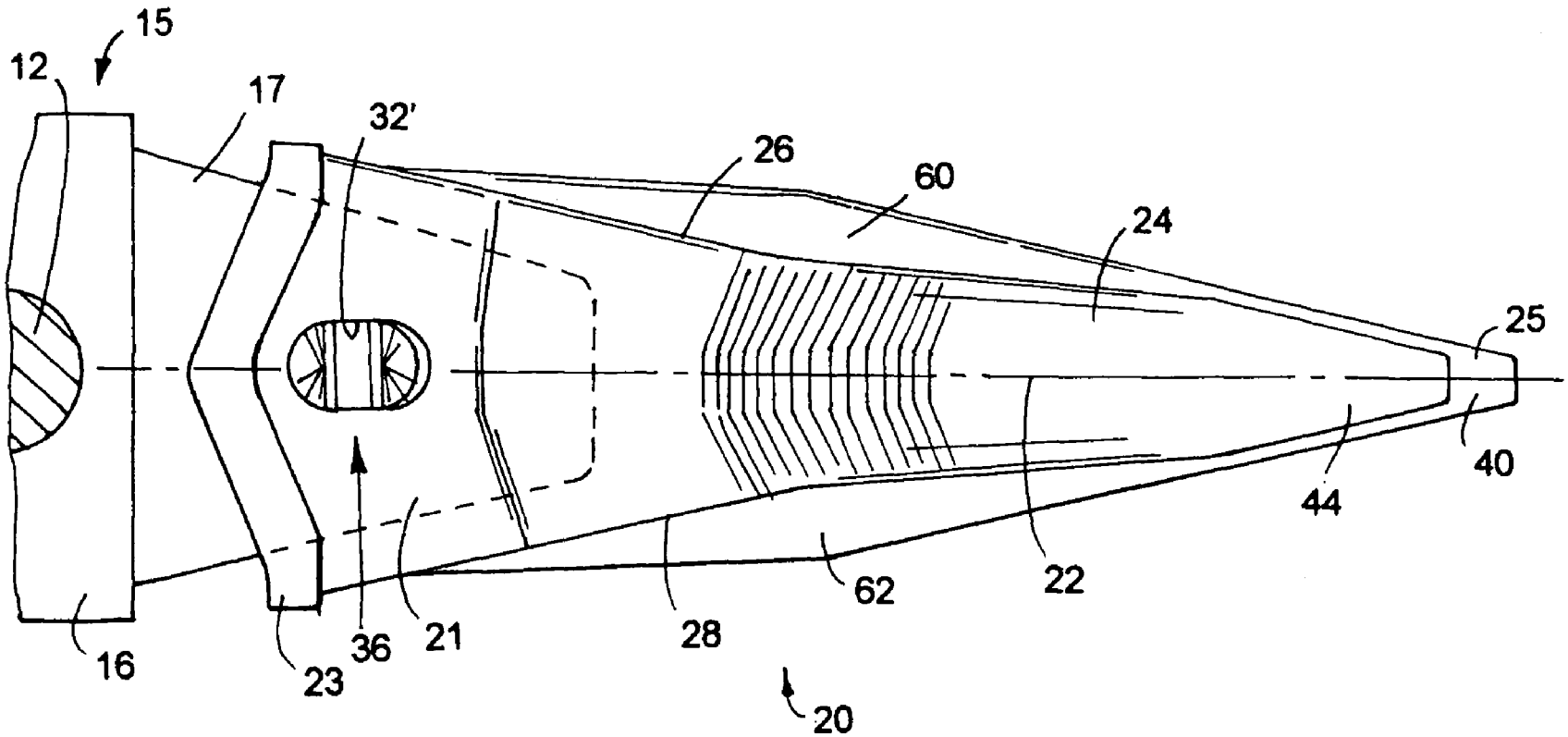
FIG. 2 is a sectional view taken along line 2-2 of FIG. 1.

In the embodiment shown in FIG. 2, each digging tooth 20 has a shank portion 21, extending forward from a rear end 23 of the tooth, and a working portion 24 extending rearward from a front or forward end 25 of the tooth. Preferably, the shank portion 21 and working portion 24 are arranged in coaxial relation relative to a central axis 22 of the digging tooth 20. Moreover, in the embodiment shown in FIG. 2, each digging tooth 20 has a top surface 26 and a bottom surface 28 which angularly diverge away from each other as they each extend rearward and away from the forward end 25 of the tooth. Each digging tooth 20 furthermore has two laterally spaced side surfaces 27 and 29 (FIG. 3) extending generally vertically between the top and bottom surfaces 26 and 28, respectively.

Figure 3:
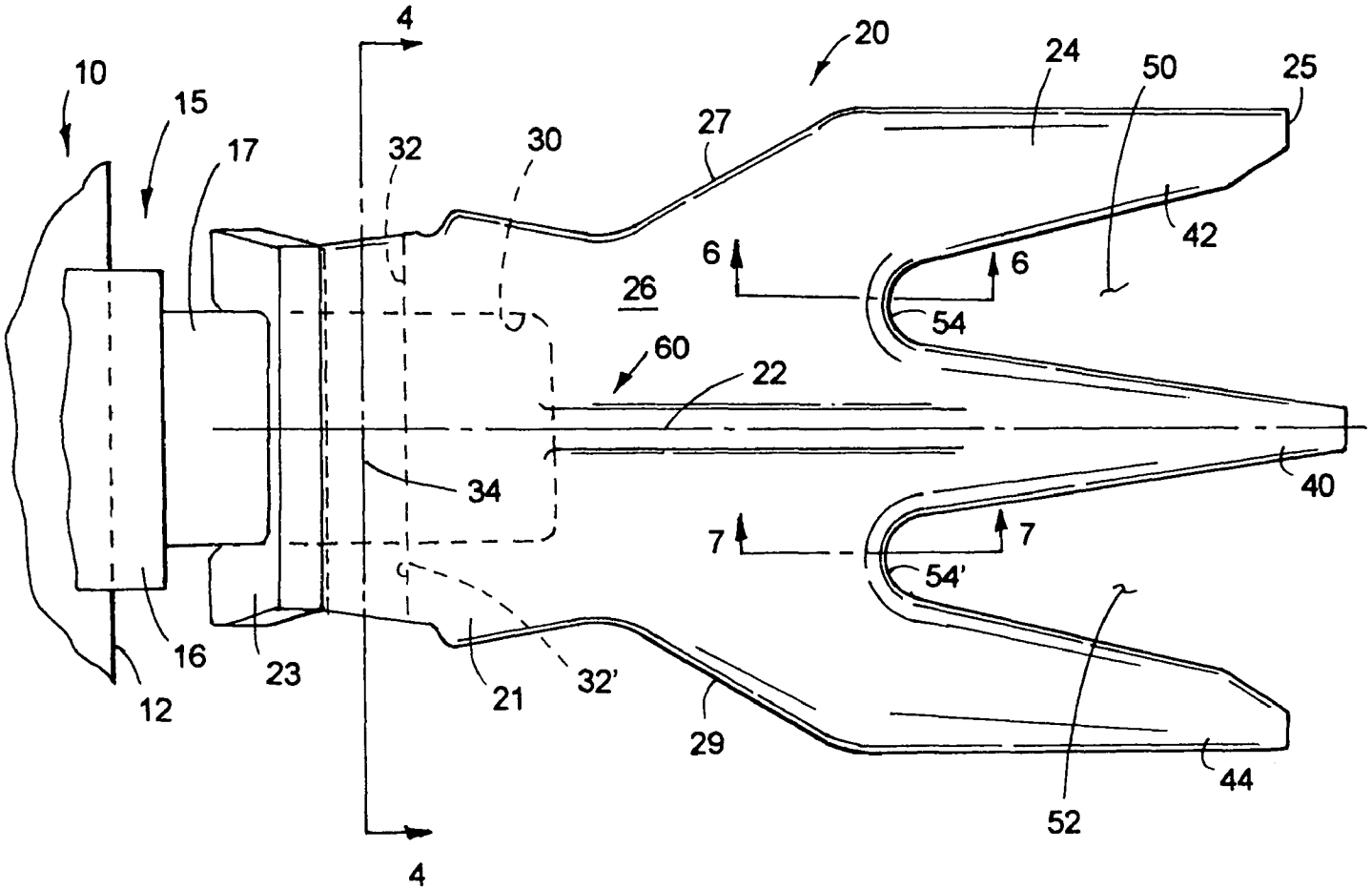
FIG. 3 is an enlarged fragmentary top plan view of one form of digging tooth embodying principals of the invention disclosure.
Figure 4:
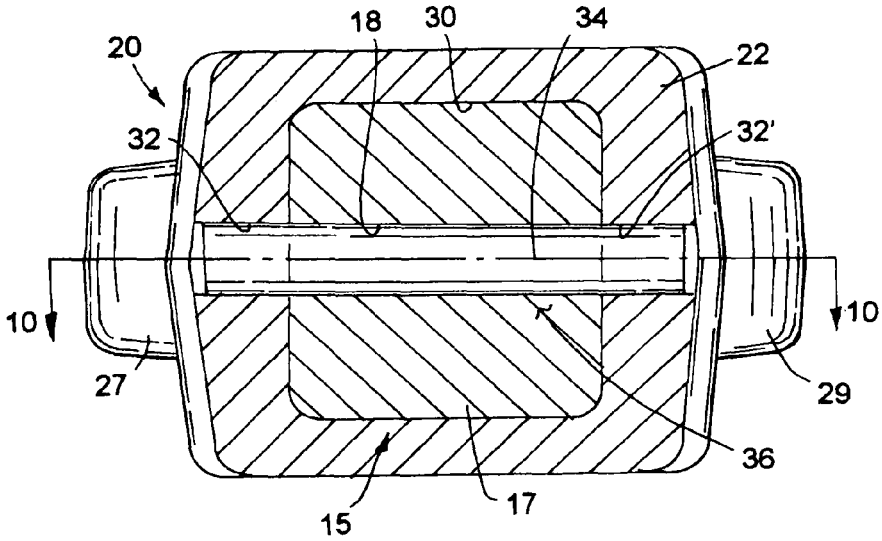
FIG. 4 is an enlarged sectional view taken along line 4-4 of FIG. 3.
Figure 5:
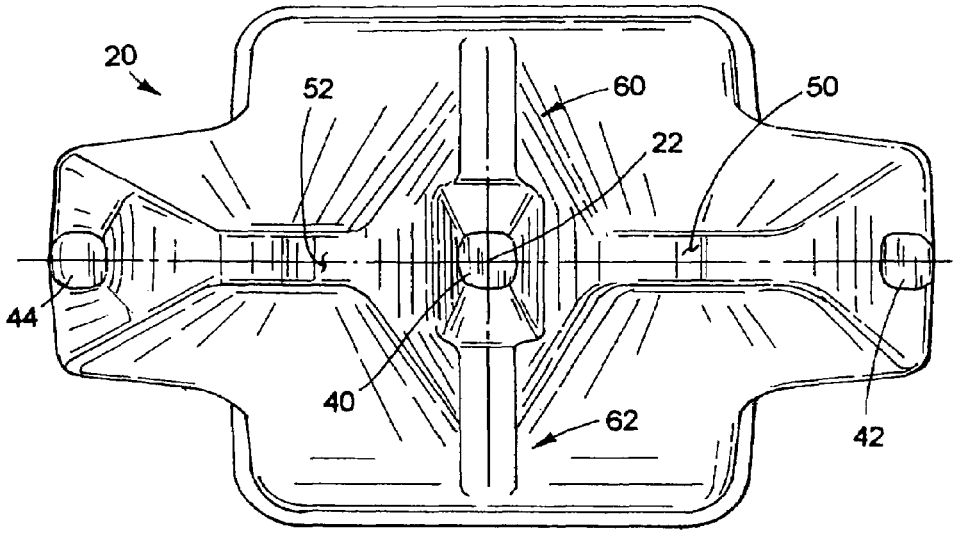
FIG. 5 is an end view of the digging tooth illustrated in FIG. 3.

Turning to FIGS. 4 and 5, the tooth shank portion 22 defines a blind cavity 30 which opens to the rear end 23 (FIG. 3) of the digging tooth. The blind cavity 30 is configured and sized to receive and accommodate a lengthwise section of the nose portion 17 of the adapter 15 whereby allowing the tooth 20 to be secured to the earth working implement 10 (FIG. 3).

Although one form of blind cavity is illustrated for exemplary purposes, it will be appreciated the blind cavity 30 can take on different shapes and sizes from that shown without detracting or departing from the spirit and scope of this invention disclosure. For example, and in an alternative from, the blind cavity 30 defined by the tooth 20 can likewise have a rhombus-like cross-sectional configuration similar to that disclosed in coassigned U.S. Pat. Nos. 6,047,487 and 6,247,255; the applicable portions of which are incorporated herein by reference.

Typically, the nose portion 17 of adapter 15 defines a generally horizontally disposed throughbore 18 for accommodating a lengthwise portion of a retainer apparatus 36 used to couple the adapter 15 and tooth 20 in operable combination. In most applications, the bore 18 defined by the nose portion 17of the adapter 15 is disposed in general alignment with the horizontal centerline axis of the adapter 15. In the embodiment illustrated in FIG. 4, the shank portion 22 of each digging tooth 20 further defines a pair of bores or openings 32 and 32'. The openings 32, 32' are aligned relative to each other along an axis 34 intersecting with and passing through the blind cavity 30 in the rear end 23 of the tooth 20.

As shown in FIGS. 3 and 5, the working portion 24 of the digging tooth 20 includes a longitudinally elongated and centrally disposed tine or projection 40 with another longitudinally elongated tine or projection 42 being arranged in outwardly cantilevered relation to the centrally disposed tine or projection 40 and still another longitudinally elongated tine or projection 44 being arranged in outwardly cantilevered relation relative to and on an opposite lateral side of the centrally disposed tine or projection 40. In a preferred form, and to enhance the versatility of tooth 20, the multiple tines or projections 40, 42 and 44 on the working portion 24 of the digging tooth 20 are all arranged relative to the central axis 22 of the tooth whereby allowing the digging tooth to be reversed about axis 22 while maintaining the tines 40, 42 and 44 in substantially corresponding relation relative to the axis 22 of the tooth 20 and to the bucket. As shown in FIG. 5, the tines 40, 42 and 44 are preferably arranged generally parallel to each other and in generally monoplanar relation relative to each other.

As shown in FIGS. 2 and 3, and to enhance initial ground penetration of the tooth 20, the centrally disposed tine 40 is preferably longitudinally longer than the tines 42 and 44 arranged on opposite lateral sides thereof. As shown, each tine 40, 42, 44 of the digging tooth 20 ranges in length between about 30% and about 65% of the overall length of the digging tooth measured between the rear end 23 and front end 25 of the tooth 20. In a preferred form, each tine 40, 42, 44 of the digging tooth 20 ranges in length between about 40% and about 52% of the overall length of the digging tooth measured between the rear end 23 and front end 25 of the tooth 20.

Preferably, the tines 42 and 44 on the digging tooth 20 are mirror images of each other about the plane of the center of the tooth. The digging tooth of the present disclosure advantageously uses the multiple tines 40, 42 and 44 to broadly distribute the loads and forces applied to the tooth. Furthermore, the multiple tines 40, 42 and 44 are specifically configured to inhibit the forward end 25 of the tooth 20 from blunting as the tines 40, 42 and 44 wear during the rough usage to which the tooth is subjected.

In the embodiment illustrated in FIG. 3, and to inhibit blunting while facilitating ground penetration, the lateral width of all the tines 40, 42, and 44 diminishes as they extend longitudinally forward on the digging tooth 20. Moreover, in the illustrated embodiment, the thickness or vertical height between upper and lower surfaces of each tines 40, 42 and 44 diminishes as the tines 40, 42 and 44 extend longitudinally forward on the digging tooth 20 so as to furthermore inhibit blunting and facilitate ground penetration. As shown in FIG. 3, the lateral distance between the side surfaces 27 and 29 at the terminal or distal ends of the tines 40, 42 and 44 is greater than the lateral distance between the side surfaces 27 and 29 of the digging tooth at the rear end 23 of the digging tooth 20. By purposefully designing the tooth such that the lateral distance between the side surfaces 27 and 29 at the terminal or distal ends of the tines 40, 42 and 44 is greater than the lateral distance between the side surfaces 27 and 29 of the digging tooth at the rear end 23 of the digging tooth 20 greater wear protection is afforded to the rearwardly disposed edge or lip 12 of the implement 10 (FIG. 1). Moreover, such design adds to the lateral spacing between the rear end of the digging tooth thereby enhancing removal/insertion of the retainer apparatus 36. In this regard, providing a greater lateral distance between the side surfaces 27 and 29 at the distal ends of the tines as compared to the lateral distance between the side surfaces 27 and 29 of the digging tooth toward a rear end of the tooth 20 furthermore adds protection to the retainer apparatus 36.

As shown in FIG. 3, the central tine 40 of digging tooth 20 is laterally separated from tine 42 by a longitudinally elongated and laterally narrowing cleft or channel 50 defined between side edges of each tine 40, 42. Similarly, tine 40 of the digging tooth 20 is laterally separated from tine 44 by a longitudinally elongated and laterally narrowing cleft or channel 52 defined between side edges of each tine 40, 44. Preferably, the confronting sides of the tines 40, 42 and 44 are configured with vertically slanted or generally convex surfaces. The two longitudinally elongated open channels on the tooth 20 provide numerous advantages during a digging operation of the tooth. Notably, the two open channels facilitate bucket fill by directing materials, worked free by the tines 40, 42 and 44 at the working portion of the tooth, to be channeled into the bucket 10 (FIG. 1) thereby promoting the bucket filling operation. Additionally, the elongated and open design of the channels 50, 52 inhibits materials, i.e., rocks, stones and related ground debris from becoming entrapped and compacted between the tines 40, 42 ands 44 thereby beneficially maintaining a high level of ground penetration for the tooth 20 during a digging operation.

In the illustrated embodiment, each cleft or channel 50, 52 longitudinally extends about 30% and about 65% of the overall length of the digging tooth measured between the rear end 23 and front end 25 of the tooth 20. In a preferred form, each cleft 50, 52 of the digging tooth 20 ranges in length between about 35% and about 52% of the overall length of the digging tooth measured between the rear end 23 and front end 25 of the tooth 20. Suffice it to say, each cleft 50, 52 extends substantially the entire length of each tine 40, 42 and 44.

Figure 6:
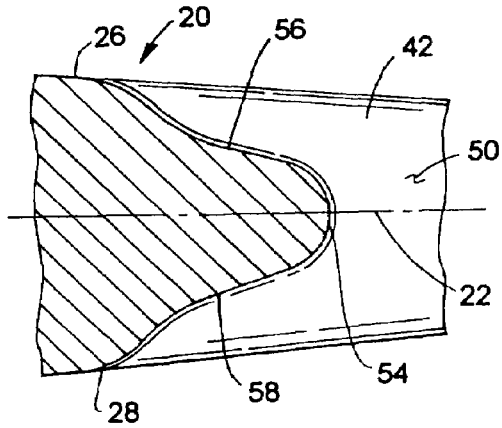
FIG. 6 is an enlarged fragmentary sectional view taken along line 6-6 of FIG. 3.

Preferably, as best shown in FIG. 3, cleft 50 terminates rearwardly from the forward edge 25 of the tooth 20 in a generally U-shaped relief 54, when viewed in plan. In the illustrated embodiment, the generally U-shaped relief 54 joins the confronting and convex sides of tines 40 and 42. Moreover, and as shown in FIG. 6, the relief 54 is specifically configured with a continuing slanted surfaces 56 and 58 extending toward the top and bottom surfaces 26 and 28, respectively, of the tooth 20 to promote continuing rearward movement of material, i.e., rocks, stones and related ground debris toward the rear end 23 of the tooth and from the channel 50 thereby further promoting the bucket filling operation.

Figure 7:
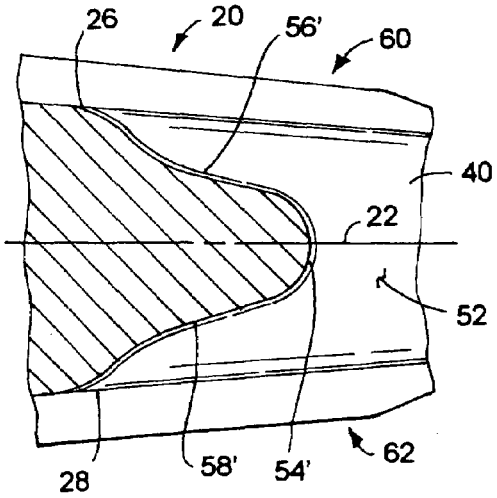
FIG. 7 is an enlarged fragmentary sectional view taken along line 7-7 of FIG. 3.

Similarly, as best shown in FIG. 3, cleft 52 terminates rearwardly from the forward edge 25 of the tooth 20 in a generally U-shaped relief 54', when viewed in plan. In the illustrated embodiment, the generally U-shaped relief 54' joins the opposed sides of tines 40 and 44. Moreover, and as shown in FIG. 7, the relief 54' is specifically configured with a continuing slanted surfaces 56' and 58' extending toward the top and bottom surfaces 26 and 28, respectively, of the tooth 20 to promote continuing rearward movement of material, i.e., rocks, stones and related ground debris toward the rear end 23 of the tooth and from the channel 52 thereby further promoting the bucket filling operation.

The generally U-shaped reliefs 54 and 54' arranged at the ends of the channels or clefts 50 and 52, respectively, provide numerous advantages during operation of the digging tooth. That is, the U-shaped reliefs 54 and 54' advantageously allow the tines 40, 42 and 44 to flex relative to each other and relative to the shank portion 22 of the tooth 20 without incurring tooth fracture. Moreover, the U-shaped reliefs 54 and 54' advantageously provide a shock absorbing feature to the tooth. That is, when any one or more of the tines 40, 42, 44 impact with a large rock or boulder during a digging operation, the U-shaped reliefs 54 and 54' tend to inhibit the tooth from fracturing as a result of such impact thereby prolonging the usefulness of the tooth in the field.

In a preferred embodiment, and as shown in FIG. 3, the upper or top surface 26 of the digging tooth 20 includes a longitudinally elongated and generally centralized web or rib 60 to add to the strength and rigidity of the central tine 40. The web or rib 60 extends longitudinally forward from the shank portion 22 of the digging tooth 20 and across a lengthwise portion of the central tine or projection 40 for a distance approximating about one-fourth to about one half the length of the central tine 40. The web or rib 60 adds a "self-sharpening" characteristic to the central tine or projection 40.

Figure 8:
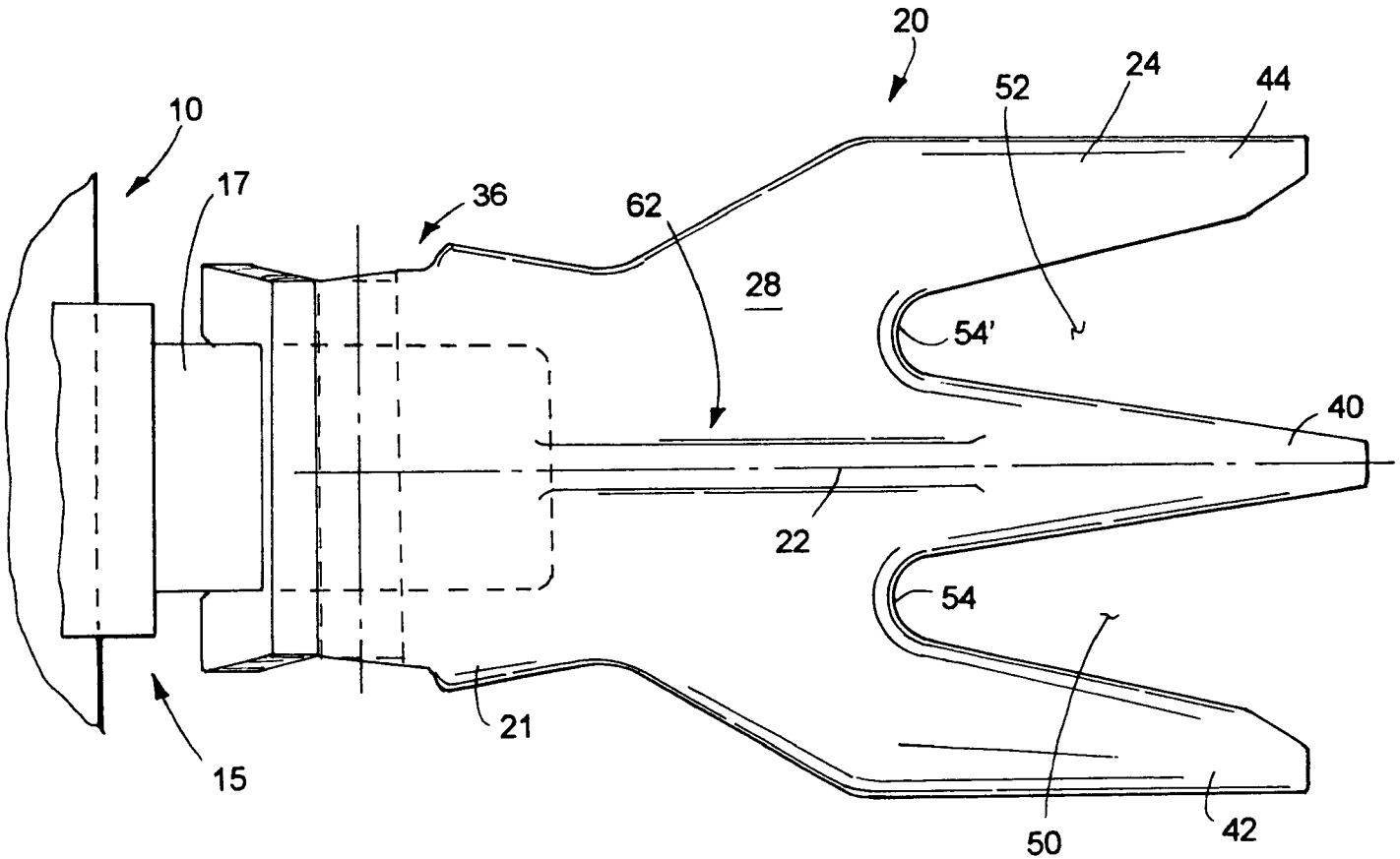
FIG. 8 is an enlarged fragmentary bottom plan view of one form of digging tooth embodying principals of the invention disclosure.

Preferably, and as shown in FIG. 8, the lower or bottom surface 28 of the digging tooth 20 also includes a longitudinally elongated and generally centralized web or rib 62 to add to the strength and rigidity of the central tine 40. The web or rib 62 extends longitudinally forward from the shank portion 22 of the digging tooth 20 and across a lengthwise portion of the central tine or projection 40 for a distance approximating about one-fourth to about one half the length of the central tine 40. The web or rib 62 adds a "self-sharpening" characteristic to the central tine or projection 40.

Figure 9:
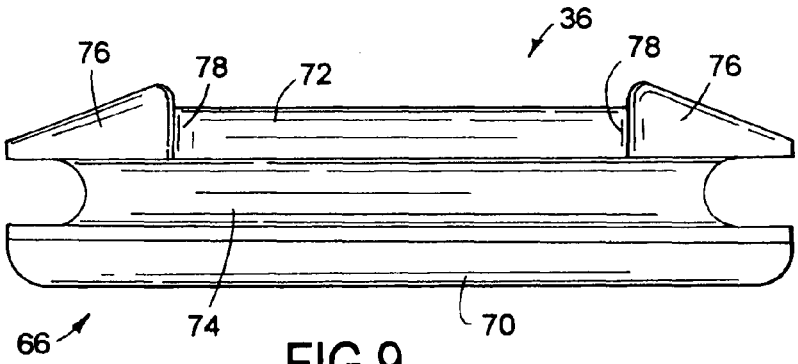
FIG. 9 is a plan view of one form of retainer apparatus for releasably coupling components of the digging tooth assembly shown in FIG. 1 in operable combination relative to each other.

The retainer apparatus 36 for maintaining the adapter 15 and digging tooth 20 in operable combination relative to each other can take various forms. Many operators prefer to use a flex-pin retainer as the retainer apparatus of choice for holding the adapter and tooth of a multipiece digging tooth assembly in operable combination relative to each other. A typical flex-pin retainer is shown in FIG. 9 and is designated generally by reference numeral 66. The flex-pin retainer 66 is generally elliptical in cross-section and includes a first pin half or elongate member 70 and a second half or elongate member 72 joined in a conventional manner by a hard yet compressible elastomer 74 secured therebetween. The pin half 70 has a beveled end portion 76 at opposite ends thereof. Suffice it to say, the flex-pin retainer 66 presents a blunt surface at opposed ends such that a hammer or other suitable tool (not shown) can be used to drive the flex-pin retainer 66 through either opening in the tooth and into the bore in the adapter. The exterior diameter of pin half 72 is abruptly reduced below the beveled end portion 76 to create a radial shoulder 78 toward each end of the flex-pin retainer 66. As is known, and when the flex-pin retainer 66 is fully inserted through either opening in tooth, the lengthwise distance between the radial shoulders 78 is sized to releasably maintain the retainer pin apparatus 66 within the bore of the adapter 15 with the remaining lengthwise portions of the flex-pin retainer 66 axially extending, at least partially, into the pin receiving bores in the sides of the tooth.

When a flex-pin retainer like that illustrated in FIG. 9 is used to operably couple the adapter and digging tooth, and when the retainer 66 has a generally elliptical cross-sectional configuration, a marginal edge of each opening 32, 32' in the digging tooth likewise has a generally elliptical cross-sectional configuration (FIG. 2). To quicken and, thus, enhance the procedure for coupling the adapter 15 and digging tooth 20 in operable combination relative to each other through use of a flex-pin retainer 66, like that shown in FIG. 9, the area arranged proximate to each tooth opening 32, 32' is configured to impart precompression to and as the flex-pin retainer 66 is inserted into position to maintain the adapter 15 and tooth 20 in operable combination relative to each other. In the embodiment shown in FIGS. 4 and 10, the openings 32, 32' in digging tooth 20 are mirror images of each other. As such, a detailed description of only opening 32 will be provided.

Figure 10:
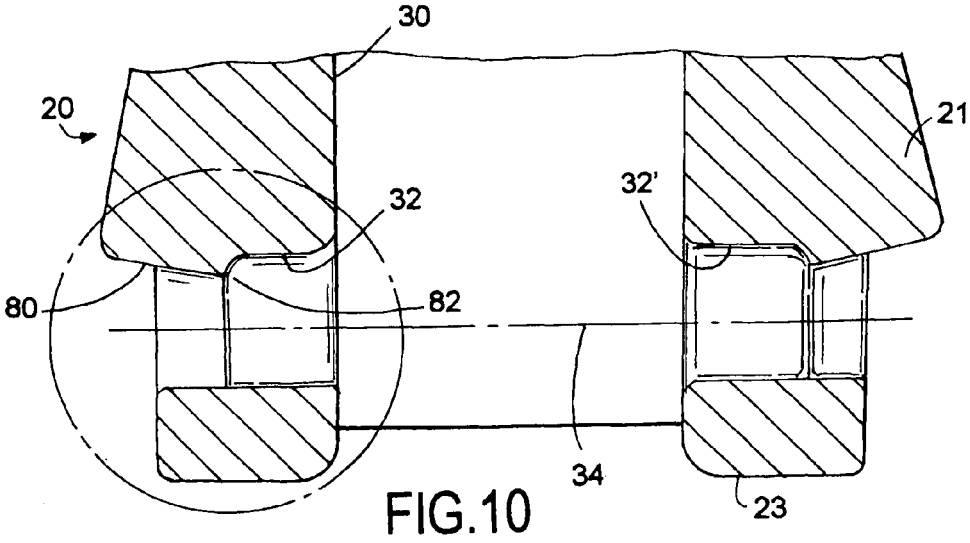
FIG. 10 is a sectional view taken along line 10-10 of FIG. 4.

As shown in FIG. 10, each digging tooth opening preferably includes an elongated camming surface 80 extending axially inward from the outermost end of the opening and toward a radial protrusion or lip 82 disposed axially between the outermost and innermost ends of each opening in the digging tooth. Suffice it to say, the radial protrusion or lip 82 effectively and radially narrows the cross-sectional configuration of the elliptical opening on the tooth through which the flex-pin retainer 66 travels along its path to the opening or bore 18 in the adapter nose portion 17 (FIG. 11).

Figure 11:
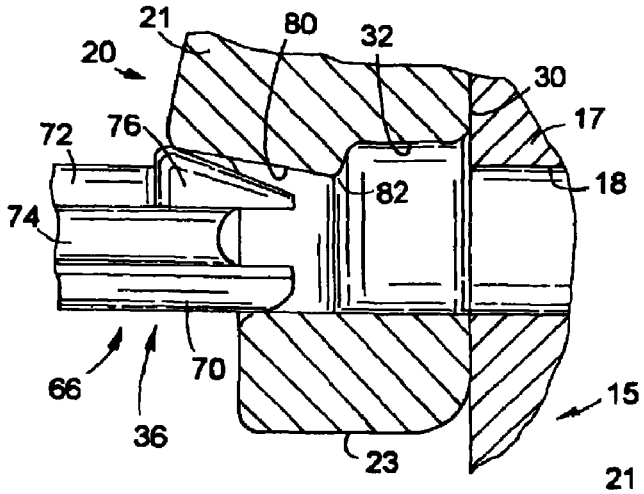
FIG. 11 is an enlarged view of the rear encircled in phantom lines in FIG. 10 and showing one form of retainer apparatus for insertion into operable association with a digging tooth.

As illustrated in FIG. 11, as the flex-pin retainer 66 is axially and forcibly driven along its path toward the bore 18 in the adapter 15, the camming surface 80 of the tooth opening engages with the beveled or chamferred end portion 76 of the flex-pin retainer 66. As such, the pin halves 70 and 72 of retainer 66 are urged or compressed toward each other as through compression of the elastomer material 74 thereby reducing the width of the elliptical flex-pin retainer 66.

Figure 12:
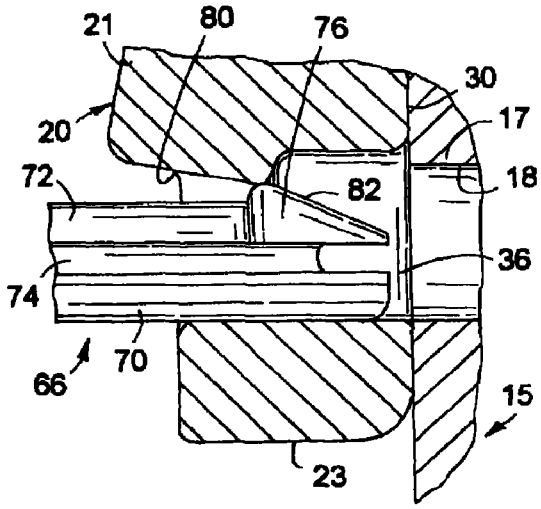
FIG. 12 is a view similar to FIG. 11 showing the retainer apparatus inserted further into operable association with the digging tooth.

As illustrated in FIG. 12, as the flex-pin retainer 66 continues along its linear path toward the bore 18 in the adapter 15, the beveled or chamferred end portion 76 of the flex-pin retainer 66 engages and moves past the radial protrusion 82. As the flex-pin 60 moves therepast, the radial protrusion 82 causes further movement of the pin halves 70 and 72 toward each other as through further compression of the elastomer material 74 whereby furthermore reducing the width of the flex-pin retainer 66. Preferably, the radial protrusion or lip 82 is axially disposed within each tooth opening or bore such that the width of the flex-pin retainer 66, at least that end disposed to enter into the bore 18 of the adapter 15, remains compressed as the end of the retainer apparatus 66 enters the bore 18 in the adapter 15. As will be appreciated, the radial compression of the retainer apparatus 66 by the radial protrusion or lip 82 facilitates entry of the end of the flex-pin retainer 66 into the bore 18 of the adapter 20.

In a preferred embodiment, the area adjacent to the openings 32, 32' in the digging tooth is furthermore preferably configured to provide a secondary lock for inhibiting inadvertent axial separation of the retainer apparatus 66 from either the adapter 15 and/or the digging tooth 20 following insertion of the retainer apparatus 36 into operative combination therewith. Such secondary lock is the provided in that area arranged proximate to each tooth opening 32, 32'.

Figure 13:
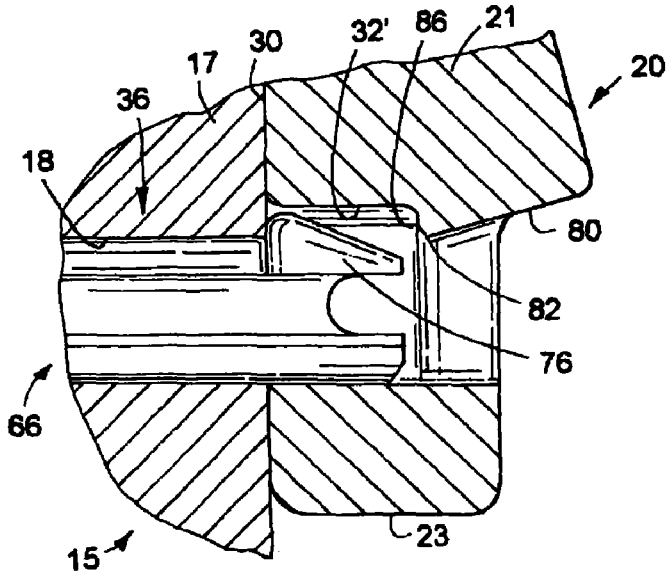
FIG. 13 is an enlarged view of a corresponding but opposite side of the digging tooth following the retainer apparatus being arranged in operable association with the adapter and digging tooth.

FIG. 13 shows the flex-pin retainer 66 as being fully inserted into operative combination with the adapter 15 and digging tooth 20. Notably, that portion of the radial protrusion or lip 82 facing toward the innermost end of each digging tooth opening in the side surface of the tooth 20 is configured with a surface or shoulder 86 which combines with the chamferred or beveled end portion 76 on the flex-pin retainer 66 following the flex-pin retainer 66 being fully inserted into operative combination with the adapter 15 and digging tooth 20. As such, and should the flex-pin retainer 66 axially or linearly shift during operation of the digging tooth assembly, the chamferred or beveled end portion 76 on the flex-pin retainer 66 will abut against the surface or shoulder 86 on the radial protrusion 82 which will thereafter halt inadvertent axial separation of the flex-pin retainer 66 relative to either the adapter or digging tooth 20 and thereby serving as a secondary lock for the retainer apparatus 36.

From the foregoing, it will be observed that numerous modifications and variations can be made and effected without departing or detracting from the true spirit and novel concept of the present invention. Moreover, it will be appreciated, the present disclosure is intended to set forth an exemplification of the invention which is not intended to limit the invention to the specific embodiment illustrated. Rather, this disclosure is intended to cover by the appended claims all such modifications and variations as fall within the spirit and scope of the claims.

What is claimed is:

1. In combination with an earth working bucket operable to excavate materials in rock hard surface conditions, a reversible one-piece digging tooth having a shank portion and a working portion extending from and arranged in axially aligned relation relative to said shank portion, with said shank portion defining a blind socket which opens to a rear end of the tooth for receiving and accommodating a lengthwise portion of a nose portion of an adapter extending forward from a leading edge of said bucket whereby allowing said tooth to be affixed to said bucket, and with the working portion of said digging tooth having more than two longitudinally disposed tines, with each tine having a lateral width and vertical height such that they withstand, without significant bending, high loads applied thereto when said tines penetrate the rock hard surface conditions in advance of the leading bucket edge and serve to excavate rocks and related ground materials into the bucket, and wherein said tines are arranged in monoplanar relation relative to each other such that they combine with each other to excavate material therebetween during a digging operation and inhibit creation of ground material crests between adjacent tines, and with said tines being symmetrically arranged relative to each other such that said tooth can be reversed about said central axis while maintaining the tines in substantially corresponding relation relative to the bucket, said tines including a longitudinally elongated and centrally disposed tine with another longitudinally elongated and outwardly cantilevered tine disposed to opposite lateral sides of and extending generally parallel to said centrally disposed tine, and with the cross-sectional width and cross-sectional height of all the tines constantly increasing as said tines longitudinally extend toward the shank portion and from a front of said tooth, and with the cross-sectional width and cross-sectional height of the centrally disposed tine being greater than the corresponding cross-sectional width and cross-sectional height of the tines disposed to opposed sides of said centrally disposed tine, and wherein opposed side surfaces on each tine angle toward but are separated from each other by a longitudinally elongated cleft which opens to a front of the tooth and terminates rearwardly from the front of the tooth in a generally U-shaped relief, when viewed in plan, so as to provide said tooth with at least two laterally narrowing guides for directing excavated materials toward the bucket and promote filling the bucket with excavated materials, worked free by the tines at the working portion of the tooth, and such that some of the materials worked free by the tines become entrapped in each U-shaped relief whereby adding wear protection to those portions of the tooth disposed rearward from the U-shaped relief.

2. The digging tooth according to claim 1 wherein, a lateral distance between side surfaces of said tooth at a terminal end of said tines is greater than the lateral distance between the side surfaces of said tooth at the rear end of said tooth.

3. The digging tooth according to claim 1 wherein, said tooth is releasably secured to the nose portion of said adapted by a retainer apparatus passing through a pair of axially aligned bores defined by the shank portion of said tooth.

4. The digging tooth according to claim 3 wherein, said tooth further includes a secondary lock for inhibiting inadvertent axial separation of the retainer apparatus from the tooth.

5. In combination with an earth working bucket operable to excavate materials in rock hard surface conditions, a reversible one-piece digging tooth having a shank portion and a working portion extending from and arranged in axially aligned relation relative to said shank portion, with said shank portion defining a blind socket which opens to a rear end of the tooth for receiving and accommodating a lengthwise portion of a nose portion of an adapter extending forward from a leading edge of said bucket whereby allowing said tooth to be affixed to said bucket, and with the working portion of said digging tooth having three longitudinally disposed tines positioned in monoplanar relation relative to each other such that they combine with each other to excavate material therebetween during a digging operation and inhibit creation of ground material crests between adjacent tines, and with said tines being symmetrically arranged relative to a central axis of the tooth whereby allowing the tooth to be reversed about said central axis while maintaining the tines in substantially corresponding relation relative to bucket, with each tine having a lateral width and a vertical height such that they withstand, without significant bending, relatively high loads applied thereto when said tines penetrate the rock hard surface conditions in advance of the leading bucket edge and serve to excavate rocks and related ground materials into the bucket, with said tines including a longitudinally elongated and centrally disposed tine and a pair of longitudinally elongated tine arranged in mirror symmetry on opposite lateral sides of and extending generally parallel to said central tine , and with the cross-sectional width and the cross-sectional vertical height of all three tines constantly increasing as said tines longitudinally extend toward the shank portion and from a front of said tooth, and with the cross-sectional width and cross-sectional height of the centrally disposed tine being greater than the corresponding cross-sectional width and cross-sectional height of the tines disposed to opposed sides of said centrally disposed tine, and wherein opposed side surfaces on each tine angle toward but are separated from each other by a longitudinally elongated cleft which opens to a front of the tooth and terminates rearwardly from the front of the tooth in a generally U-shaped relief, when viewed in plan, so as to provide said tooth with two laterally narrowing guides for directing excavated material toward the bucket and promote filling the bucket with excavated material, and with said central tine having a greater longitudinal length than either of the other two tines, and with some of the materials worked free by the tines becoming entrapped by the guides in each U-shaped relief whereby adding wear protection to those portions of the tooth disposed rearward from the U-shaped relief.

6. The digging tooth according to claim 5 wherein, said tooth is releasably secured to the nose portion of said adapter by a pin passing through a pair of bores defined by the shank portion of said tooth, which bores are aligned along an axis.

7. The digging tooth according to claim 5 wherein, the bores defined by the tooth are aligned along an axis, and wherein the axis defined by the bores of said tooth intersects with and passes through the blind socket defined by the shank portion of said tooth.

8. The digging tooth according to claim 5 wherein, a lateral distance between side surfaces of said tooth at a terminal end of said tines is greater than the lateral distance between the side surfaces of said tooth at the rear end of said tooth.

* * * * *